United States Patent [19]

Hsu

[11] Patent Number: 4,512,170

[45] Date of Patent: Apr. 23, 1985

[54] PROCESS AND APPARATUS FOR STRIP FLATNESS AND TENSION MEASUREMENTS

[75] Inventor: Yu-Wen Hsu, Livermore, Calif.

[73] Assignee: Kaiser Aluminum & Chemical Corporation, Oakland, Calif.

[21] Appl. No.: 537,868

[22] Filed: Sep. 30, 1983

[51] Int. Cl.[3] ..... B21B 37/04; G01L 5/04

[52] U.S. Cl. ..... 72/17; 72/205; 73/862.07; 73/159

[58] Field of Search ..... 72/17, 8, 18, 34, 205; 73/862.07, 159, 862.45, 862.47, 862.48

[56] References Cited

U.S. PATENT DOCUMENTS

| | | | |
|---|---|---|---|
| 2,809,519 | 10/1957 | Kaestner | 73/862.07 X |
| 3,413,846 | 12/1968 | Flinth . | |
| 3,557,614 | 1/1971 | Muhlberg . | |
| 3,581,536 | 6/1971 | Terwilliger | 72/17 X |
| 3,611,764 | 10/1971 | Asano | 72/8 |
| 3,703,097 | 11/1972 | Kilpatrich et al. | 73/159 |
| 3,850,032 | 11/1974 | Rodach et al. . | |
| 3,890,834 | 6/1975 | Henze . | |
| 3,902,363 | 9/1975 | Ishimoto | 73/159 |
| 3,916,661 | 11/1975 | Hargreaves | 72/17 |
| 4,116,029 | 9/1978 | Fabian et al. | 72/17 X |
| 4,188,809 | 2/1980 | Ishimoto et al. | 72/17 |
| 4,262,511 | 4/1981 | Boisvert et al. | 72/17 |
| 4,269,051 | 5/1981 | Clarke et al. | 72/17 |
| 4,289,005 | 9/1981 | Cabaret et al. | 72/17 X |
| 4,300,403 | 11/1981 | Berger et al. | 73/862.07 |
| 4,309,902 | 1/1982 | Sano et al. | 73/159 |
| 4,332,154 | 6/1982 | Nordvall | 72/31 |

FOREIGN PATENT DOCUMENTS

| | | | |
|---|---|---|---|
| 0595641 | 2/1978 | U.S.S.R. | 73/862.07 |

*Primary Examiner*—Lowell A. Larson
*Assistant Examiner*—Steven B. Katz
*Attorney, Agent, or Firm*—Andrew E. Barlay

[57] ABSTRACT

A process and apparatus for on-line measurement of unflatness of hot or cold rolled strip products, wherein the longitudinal bending of a shape roll over which the strip passes provides a measure of the unflatness of the strip. Actual values of force, displacement or bending moment near the ends of the shape roll may be compared to theoretically predicted values for a flat product and for product having various out-of-flatness conditions. Preferably, the shape roll is supported at its ends by two pairs of supports, and the measurements at the supports are used in determining roll bending and then strip unflatness. Other conditions such as off-center strip and asymmetric operation of the rolling mill may also be determined from the measurement.

18 Claims, 7 Drawing Figures

PROCESS AND APPARATUS FOR STRIP FLATNESS AND TENSION MEASUREMENTS

BACKGROUND OF THE INVENTION

This invention relates generally to metal deforming operations, and, more particularly, to a process and apparatus for measuring unflatness of strip in a rolling mill.

Strip products of materials such as aluminum are typically manufactured by passing thick pieces of the material through a rolling mill. It is highly desirable that the rolled strip be flat over its entire length and width, and not have excessive residual stresses which would cause it to buckle, as such imperfections may cause the strip to break and may reduce fabricability in subsequent forming operations. Flatness and residual stress imperfections arise from a variety of causes, such as a rolling mill which is not level or has excessive dimensional variations along its axis, plugged coolant spray nozzles, tension asymmetries, and other causes which may be corrected by the mill operator or a process computer if the problem can be detected and recognized even as the rolling progresses. To this end, various types of on-line measuring equipment have been devised for monitoring a strip as it exits from the rolling mill.

Standard tensiometer rolls having a single pair of instrumented supports are commonly found in rolling mills. Such single-support tensiometer rolls can measure the total force and side-to-side differential force exerted by the strip on the roll, but not various other conditions of imperfect rolling, such as unflatness. For the latter condition, several methods of measurement have been proposed, including a series of commonly supported, laterally adjacent rollers which allow measurement of the strip tension at a series of points across the width of the roll. In another variation, coaxial rollers having a plurality of internal load cells similarly provide information concerning the distribution of strip tension across the width of the strip. From the distribution of strip tension, conclusions can be drawn about the flatness of the strip. In an alternative approach, photocells or other non-contact proximity sensors may be used to detect the flatness, thickness, or residual stress.

All of the previously proposed on-line flatness measurement processes and apparatus suffer from the common problem of extreme complexity and high maintenance cost. Some of the existing flatness measurement apparatus use a segmented roll body which may be the source of undesirable marking of the strip. Further, high capital investment costs are usually associated with such complex machines. Calibration of the multiple sensors or load cells typically involved in such apparatus is a continuing problem, particularly with apparatus employing photocells. In most instances, the complex apparatus is not usable in hot rolling operations because the measuring devices must be positioned too closely to the strip to be properly cooled.

Accordingly, there has been a continuing need for a less complex process and apparatus to detect mechanically induced rolling imperfections such as out-of-flatness conditions. Such apparatus should be highly reliable and easy to maintain, and be capable of detecting commonly occurring rolling problems. Preferably, such apparatus would be based upon a standard piece of apparatus already available in most strip rolling mills, so that capital investment costs and duplication of function would be minimized. The present invention fulfills this need, and further provides related advantages.

SUMMARY OF THE INVENTION

The present invention resides in a process and apparatus for detecting flatness variations and other mechanical imperfections arising in the rolling of strip products, wherein a roll or its support structure is instrumented to permit determination of the load distribution imposed by the strip on the roll body, from measurements of reaction characteristics such as force, displacement, or bending moment, preferably made at sensing positions located near the ends of the roll. When the roll is used as a shape roll, it performs the functions of a standard tensiometer as well as those of flatness measurement, is reliable and easy to maintain, and may be used to monitor hot rolling processes because the instrumentation is positioned remotely from the working surface in contact with the hot metal.

In accordance with the invention, the apparatus includes means for determining mechanical imperfections of the strip from the longitudinal bending of the roll body under the load imposed by the strip as it passes over the roll, using measurements of reaction characteristics preferably made at sensing positions near the ends of the roll. Desirably, the roll is supported at its ends by two pairs of instrumented supports, and the data gathered at these sensing positions is used to deduce the presence of out-of-flatness and other mechanical imperfections of the strip passing over the roll. The measurements at the supports are compared with those predicted theoretically for a flat strip and various configurations of unflat strips, and the condition of the strip is thereby determined from the support measurements.

The present invention also extends to a process for determining mechanical imperfections of the strip from the longitudinal bending of the roll body under the load imposed by the strip as it passes over the roll, using measurements of reaction characteristics preferably made at sensing positions near the ends of the roll. Desirably, reaction characteristics are measured at two oppositely disposed pairs of sensing positions adjacent the opposite ends of the roll. These measured reaction characteristics are compared with those predicted theoretically for a flat strip and various configurations of unflat strips, and the condition of the strip is thence determined from the support measurements.

More specifically, there are several kinds of commonly occurring mechanical rolling defects, such as center buckles and edge waves. Utilizing elastic beam theory, the reaction characteristics expected at the sensing positions can be calculated for such mechanical rolling imperfections, and then the actual measured values may be compared with the expected values. Variations in the total forces between the two ends of the shape roll indicate asymmetric loading of the roll by the strip, which in turn may be related to a variety of problems. Other kinds of imperfections may further be detected from the reaction characteristics measured at the two pairs of sensing locations.

It will be appreciated from the foregoing that the present invention represents a significant advance in the measurement of mechanical rolling imperfections as strip products are being rolled. The preferred apparatus and process utilize the well-proven technology of supporting a measurement roll through instrumented bearing supports on the roll neck of the roll, well separated from the roll body which actually contacts the strip material. In the preferred embodiment, the total strip tension and side-to-side strip tension variation may be determined as with a conventional tensiometer roll. The addition of a second set of instrumented bearing supports, and the processing of their measured forces in conjunction with the forces on the first pair of bearing supports, allows determination of the most commonly occurring rolling defects, in either hot rolling or cold rolling operations. Other features and advantages of the present invention will become apparent from the following more detailed description of the preferred embodiment, taken in conjunction with the accompanying drawings which illustrate, by way of example, the principles of the invention.

BRIEF DESCRIPTION OF THE DRAWINGS

FIG. 1 presents perspective views of two metal strips, illustrating commonly occurring rolling defects.

DETAILED DESCRIPTION OF THE PREFERRED EMBODIMENT

Figure 1A:
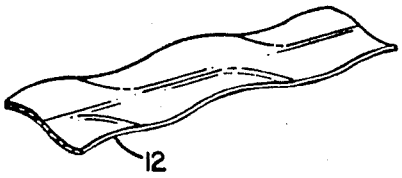
FIG. 1A illustrates an edge wave.

As is shown in the drawings for purposes of illustration, the present invention is embodied in a dual support shape roll 10 for detecting and measuring mechanical imperfections, such as those illustrated in FIG. 1, in a rolled strip 12, as well as for measuring strip tension of the strip 12 as it is being rolled. The dual support shape roll 10 is placed on-line with a rolling mill stand on the exit side of the mill. The strip emerging from the rolling mill passes over a roll body 14 of the dual support shape roll 10, whereby rolling defects and strip tension are determined from measurements of the forces on two pairs of instrumented supports. While the preferred embodiment of the invention is described in terms of a shape roll placed on the exit side of the mill, those skilled in the art will recognize that the invention may be applied in other contexts, such as, for example, instrumented work rolls or a shape roll placed between roll stands of a multistand mill.

In accordance with a preferred embodiment of the invention, the roll body 14 of the dual support shape roll 10 is supported by two pairs of instrumented supports comprising sensing positions, rather than by a single pair of instrumented supports as found in conventional tensiometers. Each of the four supports is instrumented to measure its respective reaction characteristic as the strip 12 passes over the roll body 14 in tension. As used herein, the term "reaction characteristic" means the response of the sensing position to the forces imposed on the roll body 14 by the strip 12, and typically the reaction characteristic may be either the force, displacement or bending moment measured at the sensing position. Most conveniently, the reaction characteristic is measured with a load cell positioned between the support and the frame of the machine. By measuring and then analyzing the reaction characteristics of the four supports, the total strip tension, side-to-side differential strip tension and strip tension distribution across the width associated with strip unflatness may be detected. The term "strip" as used herein denotes strip, sheet, and other generally flat products which may be measured by the dual support shape roll. A "sensing position" is a location whereat a measurement of a reaction characteristic is taken, and is preferably but not necessarily a load-carrying support structure. Finally, the preferred apparatus is referred to herein as a "dual support" shape roll. The term "dual support" relates to the use of two pairs of supports.

Figure 2:
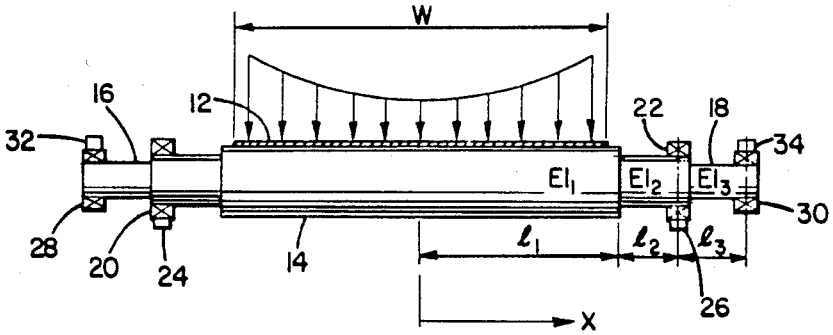
FIG. 2 is a schematic front elevational view of a dual support shape roll for flatness measurement, with an indication of the loading pattern resulting from a strip having the center buckle of FIG. 1B.

A schematic form of one preferred embodiment of the invention is illustrated in FIG. 2. The cylindrical roll body 14 has a pair of roll necks 16 and 18 extending from either end thereof, along the cylindrical axis of the roll body 14. The primary support for the roll body 14 and the strip 12 passing thereover is provided by a pair of inner bearings, including a first inner bearing 20 and a second inner bearing 22. The pair of inner bearings 20 and 22 are disposed at the opposite ends of the roll body 14 and receive the respective roll necks 16 and 18 therein, thereby providing the primary support structure for carrying the weight of the dual support shape roll 10 and the force of the strip 12 pressing downwardly on the roll body 14. The inner bearings 20 and 22 are in turn respectively supported by a pair of load cells, including a first inner load cell 24 and a second inner load cell 26.

A pair of outer bearings, including a first outer bearing 28 and a second outer bearing 30, are also disposed at the opposite ends of the roll body 14 and receive the roll necks 16 and 18 therein, but the outer bearings 28 and 30 are positioned on the roll necks 16 and 18 at locations further outwardly from the respective inner bearings 20 and 22. The outer bearings 28 and 30 are supported by a first outer load cell 32 and a second outer load cell 34, respectively. As will be described more fully hereinbelow, the strip tension and presence of misalignment or mechanical imperfections may be determined from measurements of the four load cells 24, 26, 32, and 34. While measurement of four load cells is preferred, the measurements could be taken from only three sensing positions, at least two of which are oppositely disposed at the ends of the roll body.

Figure 3:
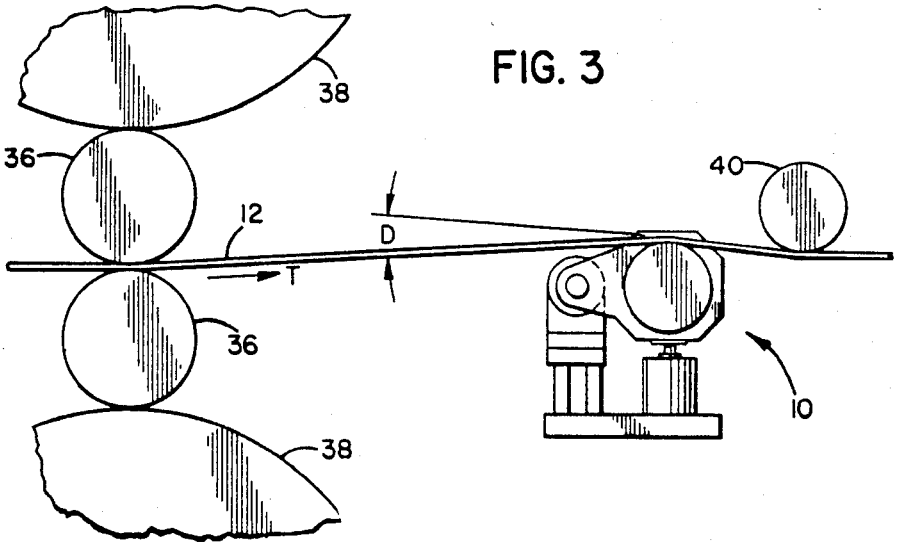
FIG. 3 is a side elevational view of a strip rolling mill with an on-line dual support shape roll installed therein.

FIG. 3 illustrates the usual manner of positioning and use of the dual support shape roll 10 on-line in a rolling mill. The strip 12 is thinned by passing it between a pair of work rolls 36. A pair of back-up rolls 38 may be provided to minimize longitudinal bending of the work rolls 36, which would result in a thickness variation across the width of the strip 12. In the view of FIG. 3, the strip 12 is driven through the work rolls 36 from left to right under a strip tension indicated schematically by the letter T.

To determine the presence of misalignment and mechanical imperfections in the rolled strip, as well as the strip tension T, the dual support shape roll 10 is positioned on the exit side of the work rolls 36, and disposed so as to displace the strip 12 upwardly and out of the plane that it would otherwise assume under the strip tension T. An idler roll 40 contacts the upper side of the strip 12 at a location yet further from the work rolls 36 than the dual support shape roll 10, forcing the strip 12 downwardly against the dual support shape roll 10. A wrap angle D may be defined as the angle between the segment of strip 12 lying between the work roll 36 and the shape roll 10, and the segment of strip 12 lying between the shape roll 10 and the idler roll 40.

When the rolling mill is level and the strip 12 is properly centered on the roll body 14, the downward force of the strip 12 on the roll body 14 is evenly distributed, so that the forces measured by the two inner load cells 24 and 26 are substantially identical to each other, and the forces measured by the two outer load cells 32 and 34 are substantially identical to each other. If the work rolls 36 are not level or the strip 12 is displaced sideways from the longitudinal center of the roll body 14, the force measured by one of the inner load cells 24 and 26 will be greater than that measured by the other. When this condition is detected, the rolling mill must be leveled or the strip 12 centered on the roll body 14 through suitable mill adjustments. As used herein, a "level" rolling mill is one having a gap between the work rolls that is symmetrical about the longitudinal center of the work rolls. In the analysis next presented, it will be assumed that such adjustments have been made, so that the rolling mill is level and the strip 12 is centered on the roll body 14.

To relate the distribution of loads on the roll body to reaction characteristics at the sensing positions, the roll body 14 and roll necks 16 and 18 of the dual support shape roll 10 may be modeled as an elastic beam carrying a distributed load across a portion of its center section, and elastically supported by two pairs of supports of known stiffness. Based upon this general premise, various approaches may be taken to predict the dependence of the loading on the two pairs of supports as a function of the load variation across the width of the strip 12. In the presently preferred analytical approach, the downward force per unit width variation across the width of the strip 12 is assumed to be approximated by the parabolic form:

$$\text{Load} = \frac{F}{W}\left(1 - \alpha\left(1 - 12\frac{X^2}{W^2}\right)\right) \tag{1}$$

Figure 1B:
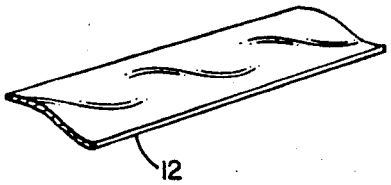
FIG. 1B illustrates a center buckle.

In this assumed functional dependence of the load, the single parameter $\alpha$ describes the shape of the load distribution. If $\alpha$ is zero, the load is evenly distributed across the width of the strip 12. However, where $\alpha$ is greater than zero, the load distribution is a concave parabola as illustrated in FIG. 2, which corresponds to a center buckle mechanical imperfection (as illustrated in FIG. 1B). Conversely, when $\alpha$ is less than zero, the load pattern is a convex parabola corresponding to an edge wave (not illustrated in FIG. 2, but corresponding to a defect of the type illustrated in FIG. 1A). Other constants required for the analysis of the roll body 14 under a distributed load are also illustrated in FIG. 2, where:

W is the width of the sheet $l_1$, $l_2$, and $l_3$ are the indicated dimensions F is the algebraic sum of the forces on the four supports $K_i$ is the spring constant for each of the pair of inner supports $K_o$ is the spring constant for each of the pair of outer supports $EI_1$, $EI_2$, and $EI_3$ are bending rigidities of the indicated sections X is the linear dimension from the center of the roll body.

The bearing reaction force R measured by each of the outer load cells 32 and 34 may be calculated by applying the principles of elasticity to an elastically supported beam carried by four supports, and bearing a distributed load of the functional form of equation (1), with the following result:

$$\frac{R}{F} = \frac{A}{2} - \left(\frac{W}{2l_1}\right)^2\left(\frac{1}{6} + \frac{2\alpha}{15}\right) B. \tag{2}$$

A and B are constants of the form:

$$A = \frac{r_2a_3(1/2 + a_2) + 1/2\, a_2^2a_3 - C_i}{C_i + C_o + a_3^2(r_2 + 1/3\, r_3a_3 + a_2)}$$

$$B = \frac{1/2\, r_2a_3}{C_i + C_o + a_3^2(r_2 + 1/3\, r_3a_3 + a_2)}$$

with $$C_i = \frac{EI_2}{l_1^3K_i} \qquad C_o = \frac{EI_2}{l_1^3K_o}$$

$$r_2 = \frac{EI_2}{EI_1} \qquad r_3 = \frac{EI_2}{EI_3}$$

$$a_2 = \frac{l_2}{l_1} \qquad a_3 = \frac{l_3}{l_1}$$

According to this result, the outer bearing reaction force R is dependent upon the shape parameter $\alpha$, the sum of the forces F, and known roll and strip constants. Equation 2 may be solved for the shape parameter $\alpha$ from measurements taken on either of, or preferably, the average of, the readings of the outer load cells 32 or 34, and the net resultant force from measurements of all four load cells 24, 26, 32, and 34. In effect such a solution compares the predicted and measured values of the reaction characteristic until the values match at the appropriate value of $\alpha$. $\alpha$ may be negative, corresponding to an edge wave; positive, corresponding to a center buckle; or zero, corresponding to a flat sheet. Where $\alpha$ is not zero, a corresponding correction signal may be sent to the rolling mill operator or control system. The objective of this control signal is to reduce the absolute value of $\alpha$ to substantially zero, and the control system can monitor the success of the control signal in achieving this objective.

It is emphasized that the scope of this invention is not to be limited by the specific model or parameters described in the preceding analysis leading to Equation 2, inasmuch as a variety of different models may be devised based upon a dual support shape roll design. Further, such models may not be confined to measurements of loading, but instead may be directed to measurements of displacement of portions of the roll, bending moments, or any other measurement providing a reaction characteristic as a function of load distribution. Measurement of forces by load cells is preferred, since such instrumentation is reliable and may be obtained commercially. Further, as indicated previously, the strip tension T may be directly calculated from the algebraic sum of the load cell measurements as:

$$T = \frac{V - R}{\text{Sin } D/2} \quad (3)$$

V is the average load reading of the inner load cells and D is the strip wrap angle.

Figure 4:
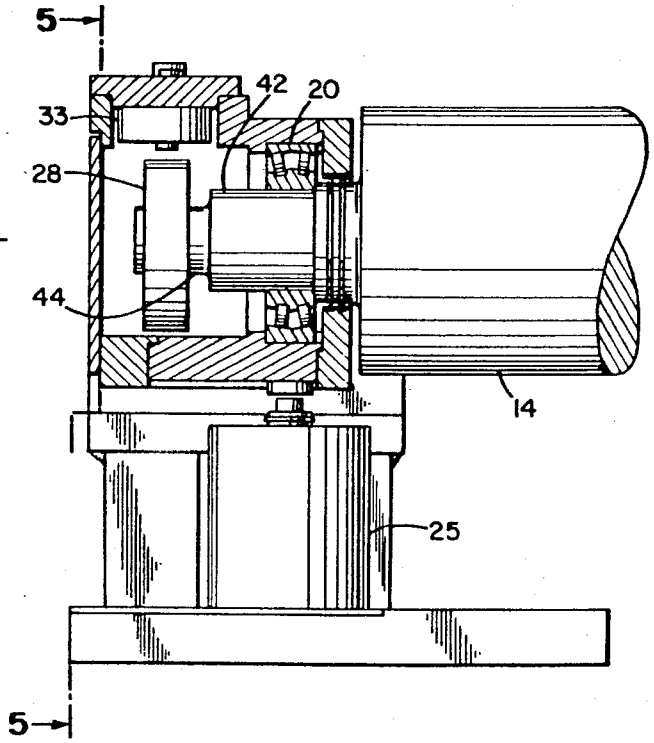
FIG. 4 is an enlarged, partially sectional front elevational view of the dual support shape roll for flatness measurement.
Figure 5:
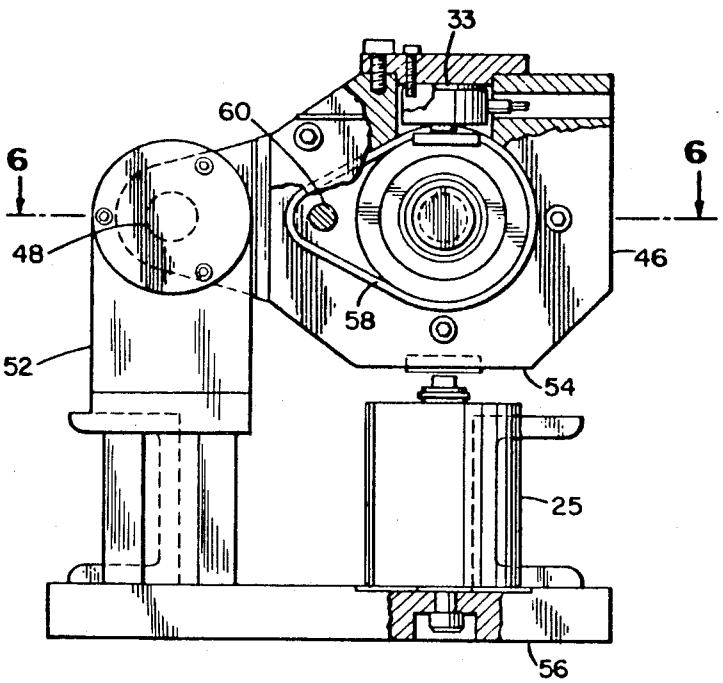
FIG. 5 is an enlarged, partially sectional, side elevational view of the shape roll, taken generally along line 5—5 of FIG. 4.
Figure 6:
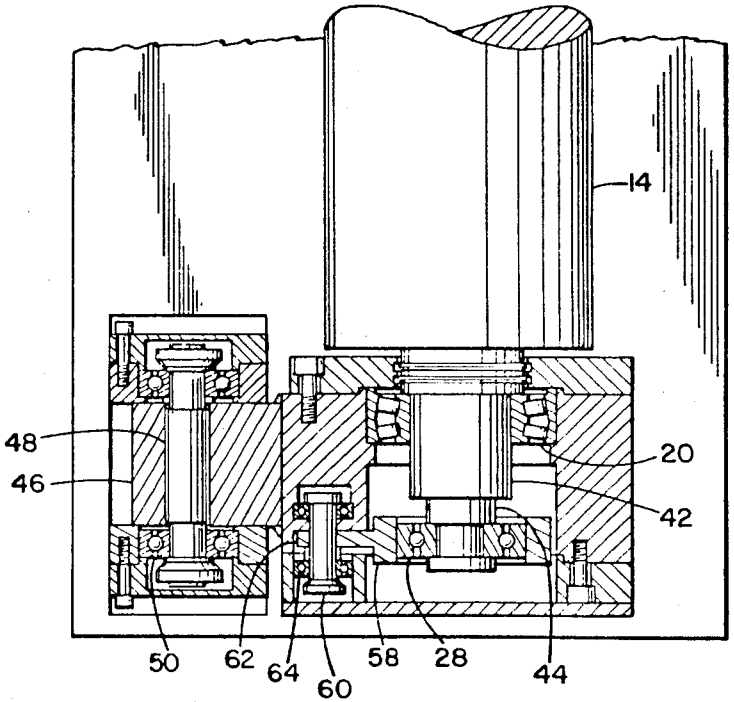
FIG. 6 is an enlarged, partially sectional top plan view of the shape roll, taken generally along line 6—6 of FIG. 5.

A most preferred structure of the dual support shape roll 10 is illustrated in FIGS. 4–6 for one end of the roll body 14. In this most preferred embodiment, the two supports at each end of the roll body 14 are enclosed in a common housing, with the housing supported by a load cell 25 termed herein a "tension" load cell. This design has practical construction advantages, as discussed hereinbelow. Additionally, it allows the force on the tension load cells 25 to be used as a measure of strip tension T, and the force on a flatness load cell 33 at the end of the roll neck to be used as a measure of unflatness.

The roll neck 16 includes first and second roll neck portions 42 and 44 respectively, extending axially from the cylindrical roll body 14. The first roll neck portion 42 is of larger diameter and extends through the inner bearing 20. The second roll neck portion 44 is of lesser diameter, and extends through the outer bearing 28. Inasmuch as the inner bearing 20 carries the majority of the weight of the roll body 14 and the forces imposed by the strip 12 passing over the roll body 14 and also should be free of resistance to bending rotation, it is preferably of a spherical roller bearing type. The outer bearing 28 carries a lesser load, and is preferably of the ball bearing type.

The inner bearing 20 is supported by a pivot plate 46, which in turn is free to pivot about a fixed point in its supporting structure. The pivot movement allows vertical movement of the roll assembly but prevents sideways movement, thereby preventing damage to the load cells, which are susceptible to damage by sideways loading. A pivot plate support pin 48 passes horizontally through a hole near one end of the pivot plate 46. Pivot plate bearings 50 allow the pivot plate support pin 48 to pivot about a pivot support base 52. The pivot plate 46, the inner bearing 20, and the roll body 14 are thereby permitted to pivot about a generally horizontal axis parallel to, and at substantially the same height as, the axis of the roll body 14.

The end 54 of the pivot plate 46 remote from the pivot plate support pin 48 rests upon, and is supported by, the tension load cell 25, which in turn rests upon a base 56. The dead weight supported by the tension load cell 25 is electronically subtracted from the force signal so that the downward component of the force exerted by the strip 12 as it passes over the roll body 14 is directly available for further analysis.

In the preferred embodiment, the outer bearing 28 is mounted to a pivot arm 58, which in turn is mounted to the pivot plate 46 by a pivot arm pin 60 which projects through a hole in the end 62 of the pivot arm 58 remote from the outer bearing 28. The pivot arm pin 60 is pivotably received in the pivot plate 46, with a pair of pivot arm bearings 64 provided to allow the pivot arm 58 to pivot freely. The pivot movement prevents undue sideways loadings, as previously discussed.

The flatness load cell 33 is interposed between the end of the pivot arm 58 adjacent the outer bearing 28, and the pivot plate 46 to measure the force at the outer bearing 28. In one example wherein the roll body 14 is a five-inch diameter hardened steel roll, the tension load cell 25 is selected to have a 1000 lb. capacity, while the flatness load cell 33 is selected to have a 500 lb. capacity.

Other aspects of the mechanical construction and assembly of the preferred dual support shape roll illustrated in FIGS. 4–6 are within the skill of those in the art.

The dual support shape roll in accordance with the invention is installed on-line in a rolling mill in the manner illustrated in FIG. 3. The height of the roll body 14 is adjusted so as to force the strip 12 upwardly to produce a wrap angle D of about 7°–9°, or otherwise as may be necessary so that the load on the tension load cell 25 does not exceed its capacity.

The dual support shape roll of the present invention must be calibrated before startup. Preferably, such calibration is performed off-line using dead loading. In the initial design of the shape roll, calculated values of constants such as A and B in equation 2 are used, and the off-line calibration yeilds the exact values for use in subsequent operations. In the dead loading calibration, various loading conditions are simulated by applying weights to the roll body and measuring the forces on the load cells. From these measurements, corrected constant values are determined for use in the on-line operations.

During the rolling process, the forces measured by the four load cells are monitored. From the total roll force F, the total strip tension T may be calculated by equation 3 (with V-R replaced by the average forces measured by the two tension load cells 25). The value of $\alpha$ is calculated from the load cell measurements and the constants, using equation 2. Alternatively, the quantity R/F may be continuously calculated or monitored and if the value deviates from that corresponding to $\alpha$ equal to zero, an out-of-flatness condition is signalled. If the value of R/F falls below that corresponding to $\alpha$ equal to zero, the value of $\alpha$ is positive and a center buckle condition is present. Conversely, if the value of R/F rises above that corresponding to $\alpha$ equal to zero, the measured value of $\alpha$ is negative and an edge wave condition is present. Whatever the method used, the out-of-flatness condition signal may then be communicated to the rolling mill operator for manual adjustment of the mill, or to automatic equipment for adjustment of the mill.

During production operations, the force values measured by the two tension load cells 25 should remain substantially equal to each other, and the forces measured by the two flatness load cells 33 should remain substantially equal to each other. If this condition is not satisfied, asymmetry of the rolling operation is indicated. Possible causes of the asymmetry include out-of-parallel work rolls 36, wandering of the strip 12 to one side of the center line of the roll body 14, a condition of asymmetric unflatness, or a mechanical malfunctioning of the rolling mill such as plugged coolant spray nozzles on one side of the mill. The out-of-symmetry indication does not identify the cause of the asymmetry, but instead serves only as a warning of the condition, which may then be investigated by the operator.

In the preferred mode of operation, the two tension load cells 25 are constantly monitored and maintained at substantially equal force values by adjustment of the levelness of the mill through control of the gap between the work rolls 36. The two flatness load cells 33 are used to determine strip unflatness using equation 2. If the two tension load cells 25 indicate substantially equal forces while the two bending load cells 33 are significantly different, an asymmetric flatness condition, possibliy due to one of the aforementioned causes, is signalled to the operator or control computer.

Some types of local flatness disturbances such as trap buckles are not directly detected by the dual support shape roll of the present invention. However, in many applications such minor, localized disturbances are not critical for the rolling process, including all instances of hot rolling, and multi-stand cold rolling except for the exit stand. Use of a proper coolant spray pattern would minimize such localized unflatness.

Although the preferred embodiment has been discussed as a dual support shape roll wherein the sensing positions correspond to the supports, those skilled in the art will recognize that other approaches to measurement of longitudinal bending are within the scope of the present invention. For example, the displacement of a sensing position may be measured by non-contact means at the roll necks or on the roll body. Further, the measurements of reaction characteristics may be of mixed type, for example, force measurements of a pair of supports and displacement measurements at the other sensing positions.

It will now be appreciated that, through the use of the process and dual support shape roll apparatus of this invention, measurements of strip tension and unflatness may be readily made. The apparatus is reliable, easily maintained, and of relatively low capital costs as compared with other on-line methods of determining strip unflatness. The relatively low capital cost allows placing of a shape roll after each stand of a multistand rolling operation. Moreover, the preferred dual support shape roll may be utilized to monitor flatness in single-stand or multistand hot rolling operations, as the load cells are positioned remotely from the hot strip and may be adequately protected from the heat.

Although a particular embodiment of the invention has been described in detail for purposes of illustration, various modifications may be made without departing from the spirit and scope of the invention. Accordingly, the invention is not to be limited except as by the appended claims.

What is claimed is:

1. A process for monitoring a continuously moving metal strip in a rolling mill comprising the steps of selecting a first and second pair of load-sensing positions, continuously supporting the moving strip under tension on an endless unitary surface rotatable about an axis and intermediate the first and second pair of load-sensing positions with the individual positions of a given pair being located at a different end of said axis and the locations of the positions of one pair of load-sensing positions being disposed in opposed relationship on an opposite side of said axis with respect to the other pair of load-sensing positions, continuously and simultaneously measuring a reaction characteristic for at least three of the load-sensing positions relative to theoretically calculated flat strip values and continuously making determinations of the unflatness of the strip from the measured reaction characteristics.

2. The process of claim 1 wherein the reaction characteristic comprises a bending force and the determination of the unflatness of the strip includes the steps of ascertaining a load-sensing position bending force corresponding to a loading pattern on the endless surface for a given one of the load-sensing positions and comparing the ascertained and measured load-sensing position bending force with the position force which has been previously theoretically calculated for said given load-sensing position for rolling flat strip to determine the loading pattern on the endless surface.

3. The process of claim 1 including the step of disposing the load-sensing positions of one of the said pairs of positions outwardly of the positions of the other pair of positions.

4. The process of claim 2 wherein the load-sensing position whose bending force is measured is one selected from the second pair of load-sensing positions and said second load-sensing position pair comprising flatness-sensing positions.

5. The process of claim 1 wherein at least two of the sensing positions from said pairs of sensing positions are located in areas where a portion of the weight of the endless surface is supported.

6. The process of claim 1 wherein the reaction characteristic comprises a deflection of a load-sensing position and said unflatness determination includes the further steps of measuring and ascertaining a calculated endless surface deflection corresponding to a loading pattern on the endless surface for one of the load-sensing positions of said first pair of load-sensing positions and then comparing the measured load-sensing position deflection to the calculated load-sensing position deflection theoretically calculated for a flat strip in order to determine the loading pattern on the endless surface.

7. The process of claim 1 wherein the reaction characteristic is a bending moment and said unflatness determination includes the steps of ascertaining a calculated load-sensing position bending moment corresponding to a loading pattern on the endless surface for the first-mentioned pair of load-sensing positions and then comparing the measured sensing positions bending moment to the theoretically calculated bending moment for the load-sensing positions to determine the loading on the endless surface.

8. The process of claim 1 including the further step of adjusting the rolling mill to eliminate the unflatness that is ascertained in said determination step.

9. An apparatus for measuring flatness of a length of metallic strip comprising a roll rotatable about a longitudinal axis and having a unitary body portion for supporting the strip, a first pair of load-sensing elements with the individual elements thereof being disposed at opposite ends of said roll, a second pair of load-sensing elements wherein the individual elements thereof are also disposed at the opposite ends of said roll, and in opposed relationship on opposite sides of said axis with respect to the load-sensing elements of said first pair of load-sensing elements, and said load-sensing elements being preset to simultaneously measure the reaction characteristics for at least three of said load-sensing elements relative to those theoretically calculated for flat strip.

10. The apparatus of claim 9 including bearing supports for said roll and at least two of said load-sensing elements being loated adjacent the roll-bearing supports.

11. The apparatus of claim 9 including means mounting the ends of said roll so as to prevent sideways movement of said load-sensing elements.

12. The apparatus of claim 10 including means mounting the ends of said roll to prevent sideways movement of said load-sensing elements.

13. The apparatus of claim 11 wherein said last-mentioned means comprises pivot plates for said roll end mounting means.

14. The apparatus of claim 12 wherein said last-mentioned means comprises pivot plates for said roll end mounting means.

15. The apparatus of claim 9 wherein the opposing pairs of load-sensing elements are located on opposite sides of the longitudinal axis of the roll.

16. The apparatus of claim 11 wherein the opposing pairs of load-sensing elements are located on opposite sides of the longitudinal axis of the roll.

17. The apparatus of claim 9 wherein the load-sensing elements of said second pair of elements are located outwardly of the elements in said first pair of elements.

18. A dual-support shape roll, comprising:

a roll having a cylindrical roll body for supporting a length of strip and a pair of roll necks for supporting the roll body extending axially from the roll body along the cylindrical axis thereof;

a pair of inner bearings at the opposite ends of said roll and receiving the respective roll necks therein;

a pair of pivot plates at the opposite ends of said roll, said pivot plates having means for respectively mounting said pair of inner bearings;

first pivot means for pivotably supporting said pivot plates to allow said pivot plates to pivot about an axis parallel to the axis of said cylindrical roll;

a pair of tension load cells in contact with said pivot plates to measure the respective loads imposed thereon;

a pair of outer bearings at the opposite ends of said roll and receiving the respective roll necks therein, each of said pair of outer bearings being disposed further from said roll body than the respective inner bearings;

a pair of pivot arms at the opposite ends of said roll, said pivot arms having means for respectively mounting said pair of outer bearings;

second pivot means for pivotably supporting said pivot arms on the respective said pivot plates to allow said pivot arms to pivot about an axis parallel to the axis of said cylindrical roll; and a pair of flatness load cells in contact with said pivot arms to measaure the respective bending loads imposed upon said outer bearings.

* * * * *